US006193579B1

(12) United States Patent
Mak

(10) Patent No.: US 6,193,579 B1
(45) Date of Patent: Feb. 27, 2001

(54) ENTERTAINMENT DOLL

(75) Inventor: Danny Wai Keung Mak, Kowloon (HK)

(73) Assignee: Well Creation Limited, Kowloon (HK)

( * ) Notice: Subject to any disclaimer, the term of this patent is extended or adjusted under 35 U.S.C. 154(b) by 0 days.

(21) Appl. No.: 09/178,435

(22) Filed: Oct. 20, 1998

(51) Int. Cl.[7] ..... A63H 3/28

(52) U.S. Cl. ..... 446/297; 446/369; 446/72; 446/73; 455/344; 40/455

(58) Field of Search ..... 446/81, 73, 297, 446/299, 302, 484, 408; 455/344, 177.1, 347; 40/455

(56) References Cited

U.S. PATENT DOCUMENTS 1,927,453 * 9/1933 Hill ..... 40/455
4,579,540 * 4/1986 Ho ..... 446/301
5,046,981 * 9/1991 Roddy ..... 446/81
5,393,257 * 2/1995 Spector ..... 446/27
5,795,213 * 8/1998 Goodwin ..... 446/297
5,908,344 * 6/1999 Kociemba ..... 446/297

* cited by examiner

*Primary Examiner*—Jacob K. Ackun
*Assistant Examiner*—Urszula M. Cegielnik
(74) *Attorney, Agent, or Firm*—G. Brian Pingel

(57) ABSTRACT

A toy in the form of a doll includes an associated radio within an interior cavity of the doll body, which radio is controlled by various switches located on the feet of the doll and utilized for turning the radio on and off and tuning the radio to a desired frequency. The doll includes a simulated headset attached in such fashion to its head so as to provide a strap for conveniently carrying the doll from place-to-place.

8 Claims, 3 Drawing Sheets

ENTERTAINMENT DOLL

BACKGROUND OF THE INVENTION

1. Field of the Invention

The present invention relates in general to a toy in the form of a doll with an associated radio, and more particularly, to a doll having a body in which the radio is enclosed and appendages having switches for controlling the operation of such radio.

2. Description of the Prior Art

It is known in the art to provide children's toys in the form of dolls having various sound producing elements. For example, U.S. Pat. No. 5,037,345 discloses a doll that produces a variety of voice expressions through the means of an electrical sound generator within the body of the doll. In a similar vein, U.S. Pat. No. 4,249,338 discloses a doll with a crying sound generator located within the interior of the doll.

The present invention differs from the above described art in that such prior devices do not contain an enclosed radio that is operable through the use of control means associated with the appendages of the doll.

SUMMARY OF THE INVENTION

The present invention provides an entertainment doll for both adults and children. The doll includes a body with an interior cavity and appendages connected to said body. A radio is located within the body cavity and means are contained in said appendages for controlling the operation of the radio.

Two of the appendages of the doll are in the form of a leg with an associated foot, with switches being located in the feet of said appendages for activating and tuning radio. Also, a headset is attached to the doll's head to provide a strap to permit a child to conveniently carry the doll about.

The foregoing and other advantages of the present invention will appear from the following description. In the description, reference is made to the accompanying drawings, which form a part hereof, and in which there is shown by way of illustration, and not of limitation, a specific form in which the invention may be embodied. Such embodiment does not represent the full scope of the invention, but rather the invention may be employed in a variety of embodiments, and references made to the claims herein for interpreting the breadth of the invention.

DETAILED DESCRIPTION OF THE PREFERRED EMBODIMENT

Figure 1:
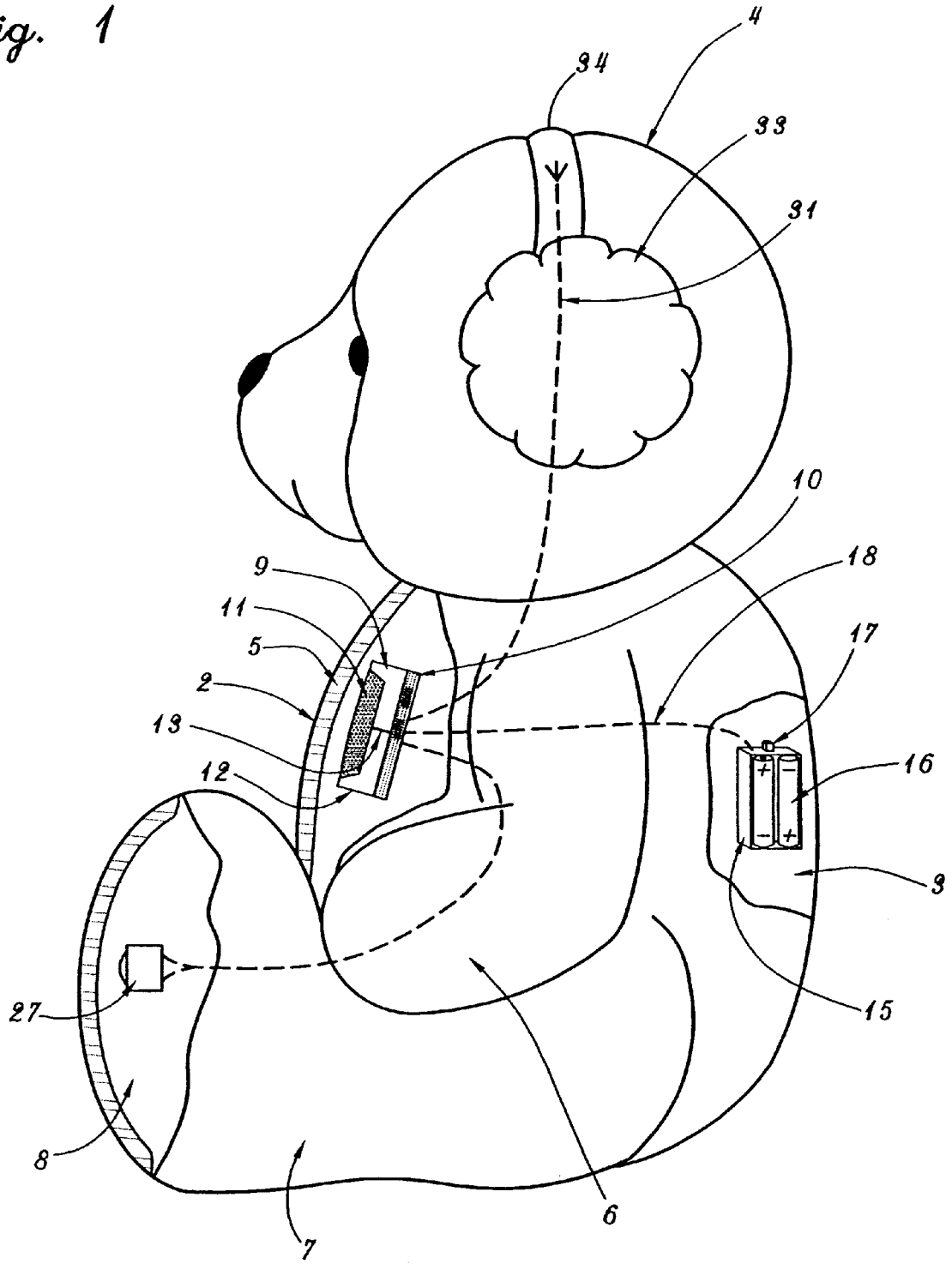
FIG. 1 is a side elevational view of a preferred embodiment of the doll of the present invention with cut-away portions to show a radio, a control switch, an antenna and a power source and phantom lines showing electrical connections therebetween in partial cut-away and partial phantom showing the doll of the present invention.

With reference now to the drawings and initially to FIG. 1, an entertainment doll, commonly referred to as a "Teddy Bear" is indicated generally at 1 in FIG. 1. The doll 1 is provided with a body portion 2 having an interior cavity 3, a head portion 4 and appendages in the form of arms 6 and legs 7 together with feet 8. The doll 1 has an exterior shell 5 that is preferably constructed of vonnel, cotton, polyester or other such type of plush material.

Located within the interior body cavity 3, is a radio 9 comprised of a control unit 10 and a speaker 11, both of which are contained within a housing 12, and are electrically connected together by a conducting means 13. The control unit 10 is preferably an integrated circuit (IC) chip that includes a radio frequency receiver. The radio 9 is electrically driven by a power source in the form of an electrical battery pack 15 for housing batteries 16 toward the rear of the interior cavity 3. The battery pack 15 has a high/low two position manual switch 17 for controlling the volume of the radio 9 and is connected to the control unit 10 by a conductor 18.

Figure 2:
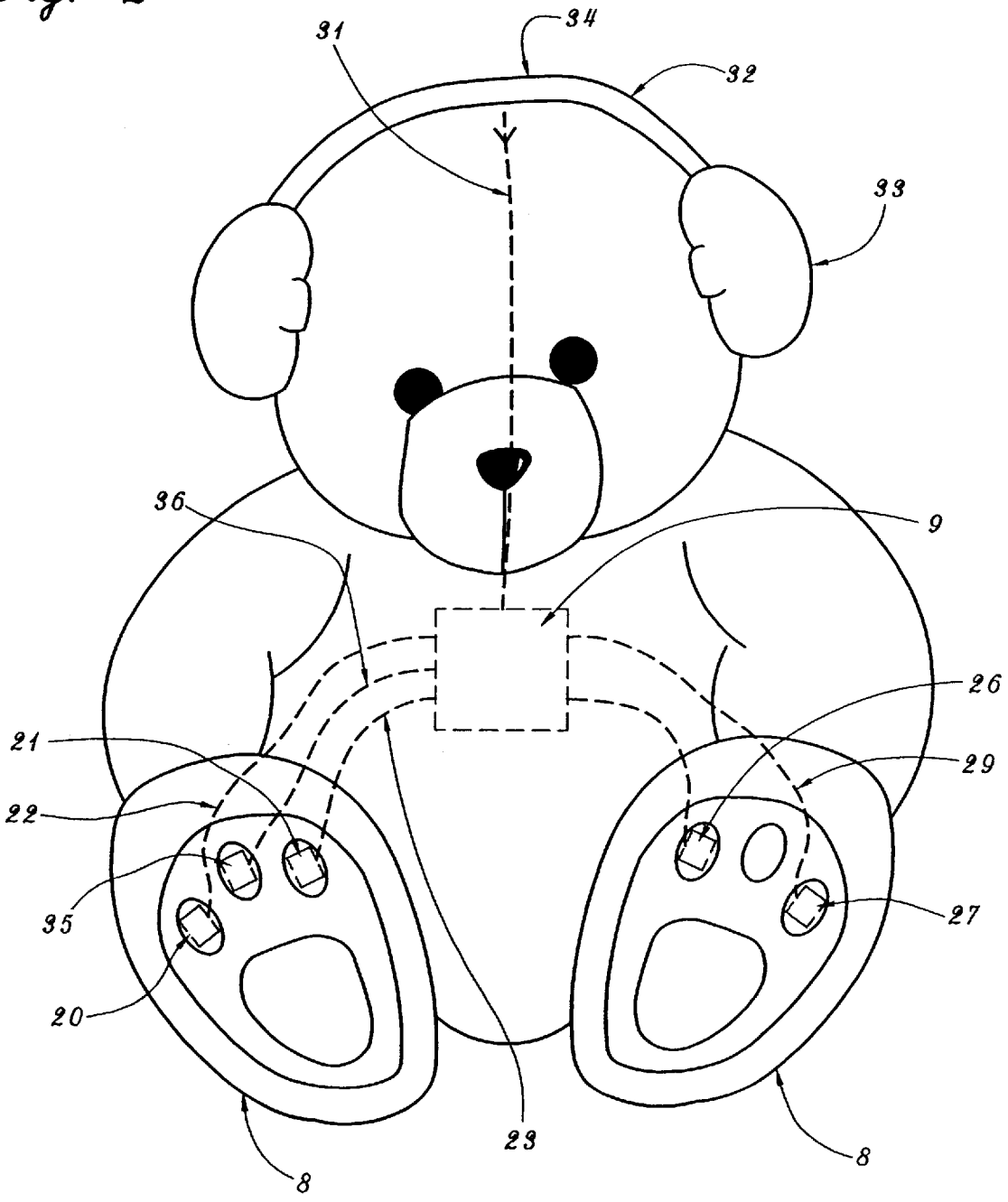
FIG. 2 is a front elevational view of the embodiment of FIG. 1 with phantom lines indicating the radio, antenna, control switches and electrical connections therebetween.

Referring now to FIG. 2, the operation of the radio 9 is directed by control means associated with the doll feet 8. The radio control means for the doll 1 includes an activation control means for turning the radio on and off and a tuning control means for determining the radio signal received by the radio 9. The activation control means is formed by an "on" pressure switch 20 and an "off" pressure switch 21 that are contained in the right foot 8 and are respectively electrically coupled to the control unit 10 by conductors 22 and 23.

The tuning control means is formed by pressure switches 26 and 27, located within the left foot of the doll 1 and respectively connected to the control unit 10 by conductors 28 and 29. The switch 27 is a "scan" switch for the control unit 10 that causes such unit to scan for a desired radio frequency in a step fashion. The switch 26 is a "reset" switch that resets the unit 10 to an initial frequency.

In operation, the doll 1 is activated by applying pressure on the pad of the right foot 8 and thereby the switch 20 to turn the doll on. To turn the doll 1 off, pressure is applied on the switch 21 and the doll 1 is deactivated. To provide tuning for the radio 9, the frequency scan switch 27 is pressed through the pad of the left foot 8. Each time the switch 27 is pressed, the radio changes frequency through the spectrum of frequencies available. The frequency of the radio can be reset by pressing the switch 26 which returns the radio back to the initial frequency.

Figure 3:
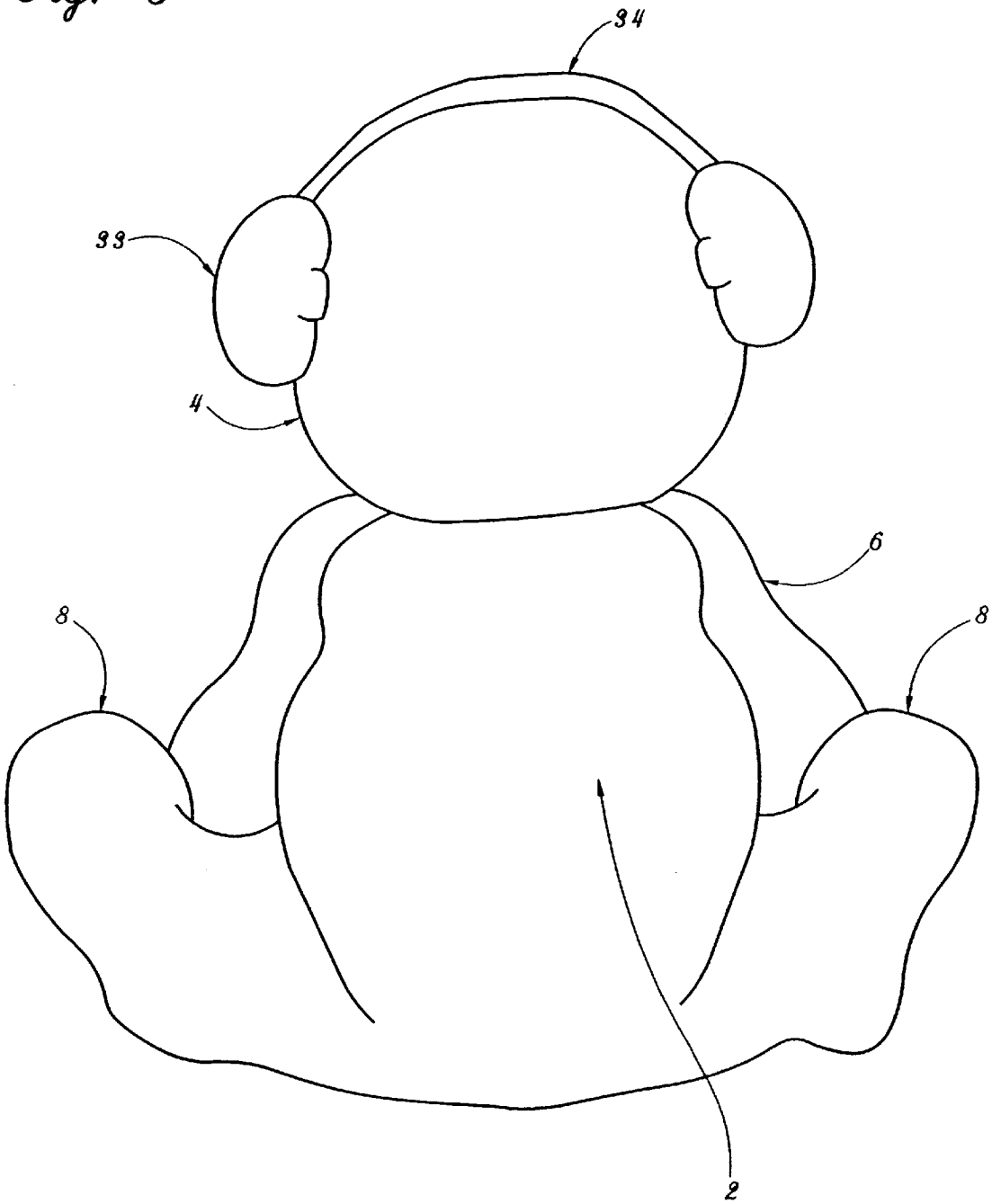
FIG. 3 is a rear electrical view of the embodiment of FIG. 1.

To improve the reception of the radio, an antenna 31 extends upwardly from the radio into the head portion 4 of the doll. Preferably, the doll head, as shown in FIGS. 1–3, has a simulated headset 32 that is formed by a pair of earphones 33 and a strap 34 therebetween. The earphones 33 are attached to opposite sides of the head 4, but the strap 34 is only attached to the earphone 33 and not to the head 4 so that such straps can be used as a carrying strap for the doll 1.

In addition to the radio control means, preferably the doll 1 also includes a light emitting diode 35 preferably positioned between the switches "on" and "off" switches 20 and 21 on the right foot 8. The LED 35 is electrically connected to the control unit by a conductor 36 so that when the radio is activated, the LED 35 will be illuminated. In this way, one is given a visual signal that the doll 1 is on.

Although the invention has been described with respect to a preferred embodiment thereof, it is to be understood that it is not to be so limited, since changes and modifications can be made therein which are within the full intended scope of this invention as defined by the appended claims. For example, the location of the radio and the power source can be varied within the cavity 1. Additionally, the control switches can be alternated between the two feet of the doll 1.

What is claimed is:

1. An entertainment doll comprising:

a) a body with an interior cavity;

b) appendages which include two arms and two legs with feet and a head connected to said body;

c) a radio located within said interior cavity and having:

i) an electric source for powering said radio;

ii) means for receiving desired radio signals;

iii) speaker means for audibly reproducing said received signal;

iv) switch means for turning said radio on and off;

v) tuning means for selecting one of said desired radio signals; and e) said tuning means for selecting one of said desired radio signals is formed by at least two pressure switches; and f) said switch means is formed by at least one pressure switch associated with one of said appendages.

2. An entertainment doll as described in claim 1 wherein a headset is secured to said head in a fashion to provide a carrying strap for said doll.

3. An entertainment doll as described in claim 1 wherein said doll is in the form of a teddy bear.

4. An entertainment doll as described in claim 1 wherein said means for selecting said radio signal includes a scan switch control to cause said receiving means to scan the signal to be received.

5. An entertainment doll as described in claim 1 includes a reset switch for resetting the receiving means to an initial frequency.

6. An entertainment doll as described in claim 5 wherein said reset switch is a pressure switch.

7. An entertainment doll as described in claim 1 wherein said switch means for turning said radio on and off comprises separate on and off switches.

8. An entertainment doll as described in claim 7 wherein an indicator comprising an LED is located between said on and off switches on said appendage to indicate whether said radio is activated.

* * * * *